US011969780B2

(12) United States Patent
Spinks et al.

(10) Patent No.: US 11,969,780 B2
(45) Date of Patent: Apr. 30, 2024

(54) WIRE SHAPING APPARATUS AND METHOD OF SHAPING A WIRE

(71) Applicant: HS Products Ltd, West Yorkshire (GB)

(72) Inventors: Simon Spinks, Leeds (GB); David Clare, Leeds (GB)

(73) Assignee: HS PRODUCTS LTD, Leeds (GB)

( * ) Notice: Subject to any disclaimer, the term of this patent is extended or adjusted under 35 U.S.C. 154(b) by 0 days.

(21) Appl. No.: 16/306,298

(22) PCT Filed: Jun. 1, 2017

(86) PCT No.: PCT/GB2017/051569
§ 371 (c)(1),
(2) Date: Nov. 30, 2018

(87) PCT Pub. No.: WO2017/207999
PCT Pub. Date: Dec. 7, 2017

(65) Prior Publication Data

US 2019/0168287 A1 Jun. 6, 2019

(30) Foreign Application Priority Data

Jun. 2, 2016 (GB) ..... 1609642

(51) Int. Cl.
*B21F 3/02* (2006.01)
*B21F 11/00* (2006.01)
(Continued)

(52) U.S. Cl.
CPC ..... *B21F 3/02* (2013.01); *B21F 11/005* (2013.01); *B21F 23/00* (2013.01); *B21F 35/00* (2013.01); *B21F 35/003* (2013.01)

(58) Field of Classification Search
CPC .... B21F 3/00; B21F 3/02; B21F 23/00; B21F 35/00; B21F 35/003
(Continued)

(56) References Cited

U.S. PATENT DOCUMENTS 3,088,642 A * 5/1963 Kingsley ..... B21F 23/00 226/176
8,336,353 B2 * 12/2012 Tsuritani ..... B21F 3/02 72/135
(Continued)

FOREIGN PATENT DOCUMENTS

DE 10 2012 204344 A1 9/2013
DE 102012204344 * 9/2013 ..... B21F 35/00
(Continued)

OTHER PUBLICATIONS

Tsuritani, Translation of JP2007030038 (Year: 2007).*
(Continued)

*Primary Examiner* — Bobby Yeonjin Kim
(74) *Attorney, Agent, or Firm* — Renner, Otto, Boisselle & Sklar, LLP

(57) ABSTRACT

Apparatus for forming wire components, which are in this example springs, comprises a supply station (202), for supplying spring forming material, such as metallic wire W. The supply station includes a pair of guide rollers (204) and pair of driven feed rollers (206), mounted on a heavy support plate (216). The wire is fed through a flexible sheath FS to a remotely located wire shaping device, in particular a spring forming device 208, comprising forming tools (210), a pitch control tool (212) and a cutter (214). The forming tools (210) and the pitch control tool (212) form the wire into a spring S, which is cut from the supply of wire when it is complete. The tools (210, 212) and cutter (214) are controlled remotely from a control station (220) via a bundle of flexible control cables (222), which may include a power cable. The spring forming device 208 is mounted on a positioning member (224), such as a robot arm or moveable table, configured for three-dimensional movement, and/or optionally adjustments in inclination. Without the heavy plate (216) and rollers (205, 206), the spring forming device (208) is sufficiently
(Continued)

light in weight and compact as to be moved by the positioning member (224) to a location in which springs are to be used, thereby avoiding the need for transportation apparatus to convey the springs from the place where they are formed to the place where they are to be used.

17 Claims, 2 Drawing Sheets

(51) Int. Cl.
*B21F 23/00* (2006.01)
*B21F 35/00* (2006.01)

(58) Field of Classification Search
USPC ..... 72/135, 145
See application file for complete search history.

(56) References Cited

U.S. PATENT DOCUMENTS

2002/0139159 A1* 10/2002 Munster ..... B21F 23/00 72/40
2004/0154365 A1* 8/2004 Tsuritani ..... B21F 35/00 72/138
2004/0231384 A1* 11/2004 Tsuritani ..... B21F 3/02 72/137
2011/0239718 A1* 10/2011 Kalkau ..... B21F 35/00 72/17.3
2017/0008064 A1* 1/2017 Clare ..... B68G 9/00

FOREIGN PATENT DOCUMENTS

DE 10 2013 206655 B3 6/2014
DE 102013206655 * 6/2014 ..... B21F 35/00
EP 1 350 581 A2 10/2003
EP 1350581 A2 * 10/2003 ..... B21F 3/02
JP 2007 030038 A 2/2007
JP 2007030038 * 2/2007 ..... B21F 3/06
WO 2015/114360 A1 8/2015

OTHER PUBLICATIONS

Wolf, Translation of DE-102012204344 (Year: 2013).*
Kunz, Translation of EP-1350581 (Year: 2003).*
Decorato, Translation of DE-102013206655 (Year: 2014).*
Corporate Assets Inc., Dominion Spring Industries, spring forming devices with forklift holes see p. 6 (Year: 2009).*
International Search Report and Written Opinion for corresponding Patent Application No. PCT/GB2017/051569 dated Sep. 26, 2017.

* cited by examiner

WIRE SHAPING APPARATUS AND METHOD OF SHAPING A WIRE

The present invention relates to apparatus and a method for shaping wire, and is concerned particularly, though not exclusively, with apparatus and a method of forming springs for resilient articles such as mattresses, seats and the like.

A previously considered spring coiling machine is depicted schematically in FIG. 1, in which the apparatus 100 typically comprises a wire supply portion 102, for supplying wire W, from a reel (not shown), in the direction of arrow A1, having a pair of guide rollers 104 and a pair of driven feed rollers 106, and a spring forming station 108, comprising forming tools 110, a pitch control tool 112 and a cutter 114, for shaping the spring S and then cutting the formed spring from the supply of wire. These elements are usually mounted on a heavy support plate 116. The apparatus shown is simplified, and some parts have been omitted from the drawing in the interests of clarity.

When the newly formed springs S have been cut from the supply of wire, they are often transported immediately to an article into which they are to be incorporated, or to which they are to be attached. Various types of transportation apparatus T are used to transport the springs, including single belts, pairs of belts and magnetic conveyors, in the direction of arrow A2 in this example.

Transporting springs, especially small ones, can be troublesome, due to their resilient nature and low mass.

The mode of transportation must be selected and carefully optimised for the springs being transported, in order to minimise the incidence of mishandling, which may lead to downtime in the process of manufacturing the articles incorporating the springs.

Because of this, whenever the type of spring is changed in the process, for example when springs of different shapes, lengths and/or of different wire gauges are to be used, the transportation arrangements must often be changed to re-optimise the process. This can also be time consuming.

The present invention is defined in the attached independent claims, to which reference should now be made. Further, preferred features may be found in the sub-claims appended thereto.

According to one aspect of the present invention, there is provided wire shaping apparatus, the apparatus comprising a supply station for supplying a length of wire to a forming device, the forming device including one or more tools for shaping a portion of the wire and cutting it from the length of wire, and wherein the forming device is arranged for movement independently of the supply station.

The invention also includes wire shaping apparatus, the apparatus comprising a supply station for supplying a length of wire to a forming device, the forming device including one or more tools for shaping a portion of wire and cutting it from the length of wire, and wherein the forming device is arranged for movement independently of a work piece in relation to which the shaped portion of wire is to be positioned.

The supply station may be located remote from the forming device.

The supply station may comprise a supply of wire, and may include a container for the wire.

The wire shaping apparatus may include feed apparatus, which may comprise one or more rollers, or pairs of rollers, such as guide rollers and/or feed rollers for guiding and/or feeding the wire to the forming device.

The forming device and feed apparatus may be arranged to move, for example together, independently of the supply station. Alternatively, the forming device may be arranged to move independently of the supply station and feed apparatus, one or both of which may be stationary.

The wire may be supplied to the forming device via a spring material conduit, preferably in the form of a sheath or sleeve, which may comprise a tube such as an armoured tube.

The apparatus may comprise a spring-forming apparatus.

The supply station may be arranged in use to supply pre-straightened, drum-coiled wire to the forming device.

The supply station preferably comprises a container, such as a drum, in which the wire is retained in a multitude of loops of substantially the same diameter around a cylindrical inside surface of the drum. The wire is preferably arranged in use to emerge from the drum under substantially no tension and substantially straight. In a preferred arrangement, the wire is then fed between guide and/or feed rollers into the forming device.

The operation of one or more tools of the forming device may be controlled remotely by a control apparatus, which may comprise a computer. The control apparatus may communicate control of the one or more tools of the forming device by cable or else wirelessly. The control apparatus may include means to control one or more of the tools remotely using one or more mechanical cables.

The forming device may comprise tools including but not limited to: one or more wire shaping tools, a pitch controlling tool, a cutter tool, a heating tool and a fixing tool, for fixing the wire to an article. The cutter tool may comprise a mechanical cutter, and/or may comprise an electrical cutter.

The apparatus may comprise one or more ancillary tools. The one or more ancillary tools may be arranged in use to move with the forming device. In a preferred arrangement, the one or more ancillary tools are arranged as part of the forming device. The one or more ancillary tools may include one or more of the following, but not limited to: a cutter, router, drill, cropper, trimmer, laser.

The one or more ancillary tools may be used, for example, to perform tasks, such as preparatory tasks or finishing tasks in respect of a work piece, in relation to which a shaped portion of wire is to be positioned.

The heating tool may be arranged in use to heat the wire by passing an electric current through the wire.

A single control apparatus may control one or more tools of a plurality of forming devices. A single supply station may be arranged in use to supply a plurality of forming devices.

The wire conduit may comprise a sheath or sleeve, preferably of plastics material.

In a preferred arrangement the forming device is moveable in two, more preferably three, dimensions. The forming device may be mounted for movement on a moveable arm or platform, or on a robotic arm or similar. Alternatively, or in addition, the forming device may be configured for hand operation, for example such that it can be manipulated by an operative to position the forming device relative to a work piece or desired location for the formed wire portion.

The wire may comprise metallic wire.

The invention also includes a method of shaping a wire, the method comprising supplying a length of wire from a supply station to a forming device, shaping a portion of wire and cutting it from a remaining length of wire using one or more tools at the forming device, and moving the forming device independently of the supply station to place the cut wire portion in a desired position.

The method may comprise moving the forming device and feed apparatus, for example together, independently of the supply station. Alternatively, the method may comprise moving the forming device independently of the supply station and feed apparatus, one or both of which may be stationary.

The invention also includes a method of shaping a wire, the method comprising supplying a length of wire from a supply station to a forming device, shaping a portion of wire and cutting it from the remaining length of wire using one or more tools at the forming device, and positioning the shaped portion of wire in relation to a work piece, wherein the method comprises moving the forming device independently of the work piece.

The method may include operating one or more tools of the forming device remotely by a control apparatus, which may comprise a computer. The method may include communicating control of the one or more tools of the forming device by cable or else wirelessly.

The method may include moving the forming device in two, more preferably three, dimensions, and may include moving the forming device using a moveable arm or platform. Alternatively, or in addition, the method may include moving the forming device by hand.

The invention also includes a method of providing wire to a wire shaping apparatus, the method comprising providing the wire to the wire shaping apparatus from a wire supply station comprising a container containing wire wound around an interior thereof in a plurality of loops, said wire shaping apparatus including a wire forming device arranged for movement relative to the container.

In a further aspect, the invention provides a computer program product on a computer readable medium, comprising instructions that, when executed by a computer, cause the computer to perform a method of shaping wire in accordance with any statement herein.

The invention also comprises a program for causing a device to perform a method of shaping wire in accordance with any statement herein.

The invention may include any combination of the features or limitations referred to herein, except such a combination of features as are mutually exclusive, or mutually inconsistent.

A preferred embodiment of the present invention will now be described. By way of example only, with reference to the accompanying diagrammatic drawings, in which.

Figure 1:
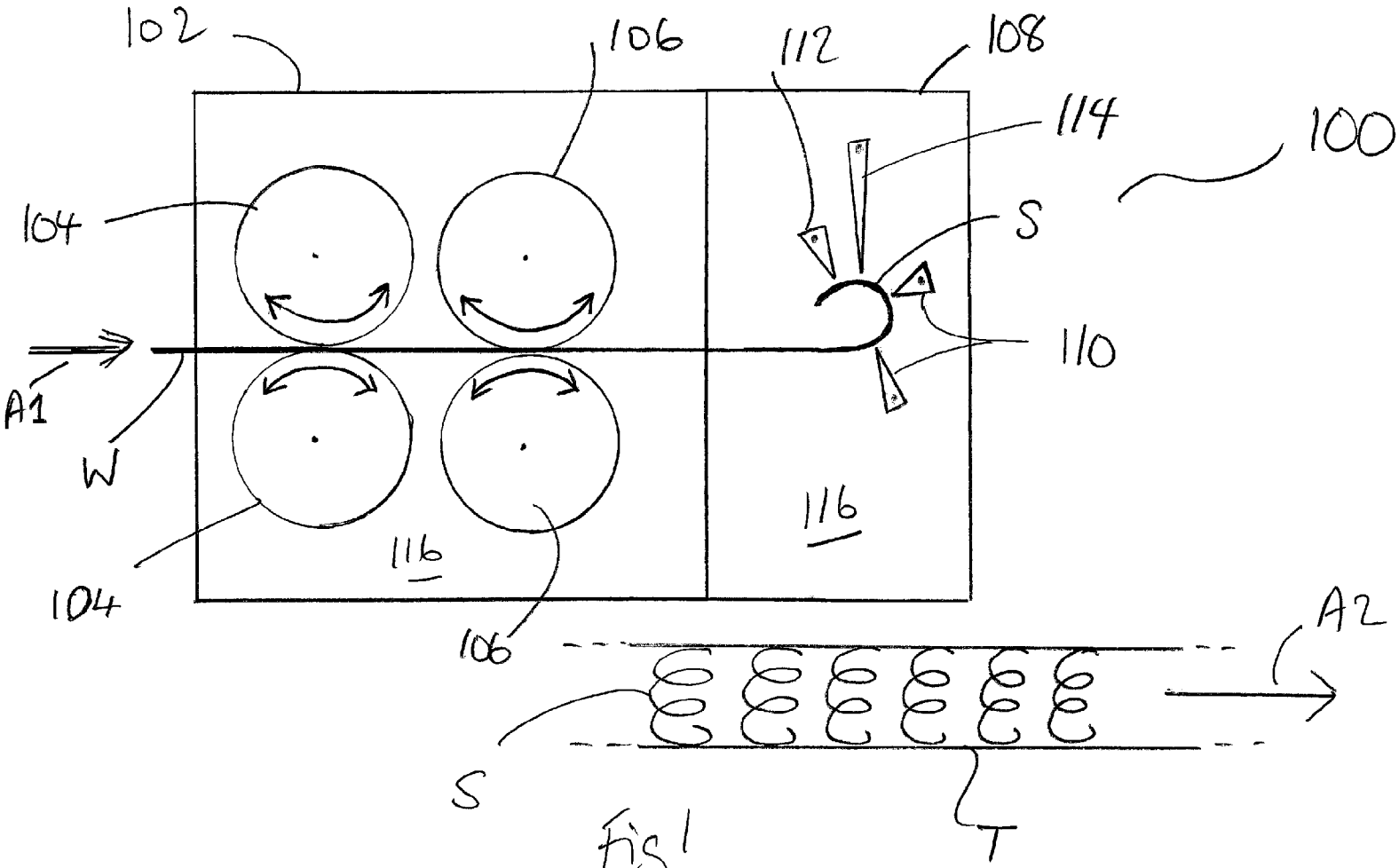
FIG 1 PRIOR ART
FIG. 1 shows a previously considered spring forming apparatus.
Figure 2:
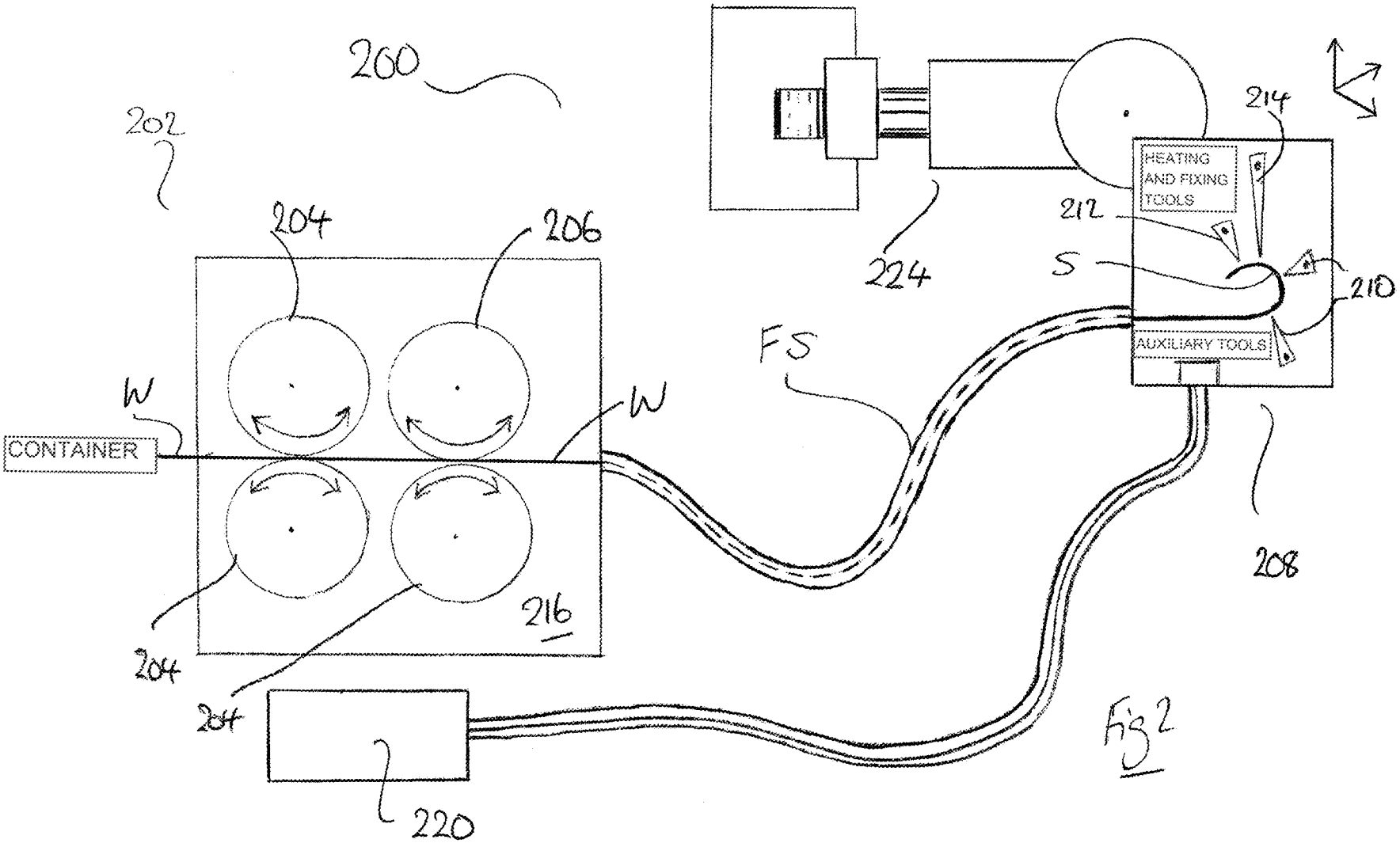
FIG. 2 shows a wire shaping apparatus according to an embodiment of the present invention.

Turning to FIG. 2, this shows schematically apparatus for forming wire components, which are in this example springs, generally at 200. A supply station 202, for supplying spring forming material, such as metallic wire W, includes a pair of guide rollers 204 and pair of driven feed rollers 206, mounted on a heavy support plate 216. The wire is fed through a flexible sheath FS to a remotely located wire shaping device, in particular a spring forming device 208, comprising forming tools 210, a pitch control tool 212 and a cutter 214. The forming tools 210 and the pitch control tool 212 form the wire into a spring S, which is cut from the supply of wire when it is complete.

A wire payoff (not shown) such as a reel, spool or preferably a drum, supplies the rollers.

The tools 210, 212 and cutter 214 are controlled remotely from a control station 220 via a bundle of flexible control cables 222, which may include a power cable (not shown). The spring forming device 208 is mounted on a positioning member 224, such as a robot arm or moveable table, configured for three-dimensional movement, and/or optionally adjustments in inclination.

Without the heavy plate 216 and rollers 205, 206, the spring forming device 208 is sufficiently light in weight and compact as to be moved by the positioning member 224 to a location in which springs are to be used. This avoids the need for transportation apparatus to convey the springs from the place where they are formed to the place where they are to be used. When springs of a different size or shape, or of a different wire gauge are to be used, they are formed and placed where they are needed, without the need to re-optimise a transportation apparatus.

In another embodiment (not shown) the forming device and light weight rollers are mounted for common movement in relation to the wire payoff, such as a wire supply in the form of a drum of coiled wire.

The control cables could comprise flexible rods or linkages, or the control could be provided wirelessly, or via electric cables. Similarly, the cutting tool 214 is shown as a mechanical device, but could, as an alternative (not shown) comprise an electric arc cutter, or similar.

The springs could be heated locally at the spring forming device, so as to treat them, and also if desired to weld or otherwise attach them to an article, such as to a metal plate or clip, or other fixture.

The forming device is also moveable with respect to a work piece, in one, two or preferably three dimensions, and optionally in inclination, with respect to a work piece.

This versatility of the wire shaping apparatus according to embodiments of the present invention allows the forming and precise placement of wire components, such as springs of different types, where they are needed, either in or on another work piece/article or in an aperture or magazine, or onto a magnetic belt, without the need for separate transportation apparatus for different types of wire components.

There are many examples of articles to which the apparatus and methods described above can precisely deliver shaped components. Such examples include, but are not limited to: automotive articles such as engines, suspensions and seating, other vehicles, plant and machinery and furniture.

Whereas the above-described example is of forming springs, it will be understood that the apparatus and methods described herein could also be used to shape a portion of wire into a configuration other than a spring.

Also, the term "wire" as used herein is intended to cover or include any filament, thread, tube or similar, whether solid or hollow, and whether metallic or not, which is capable of being shaped in the manner described above.

Similarly, it will be understood by the skilled person that a single control apparatus may be used to control one, or more than one, of the tools of a plurality of forming devices. Thus, a relatively expensive control apparatus can be used with a plurality of less expensive wire shaping heads.

The remote control of the one or more tools can be by mechanical, electrical or electronic means and may use cables and/or wires or wireless signal paths, or a combination of these.

As stated above, the forming device and a relatively light weight feed apparatus may be arranged to move, for example together, independently of the supply station by mounting them on a moveable positioning member such as 224. Alternatively, the forming device may be arranged to move independently of the supply station and feed apparatus, one or both of which may be stationary.

In another embodiment (not shown) the apparatus has one or more ancillary tools. The one or more ancillary tools may be arranged in use to move with the forming device, and are preferably arranged as part of the forming device. The one or more ancillary tools may include one or more of the following, but not limited to: a cutter, router, drill, cropper, trimmer, laser, and may be used, for example, to perform tasks, such as preparatory tasks or finishing tasks in respect of a work piece, in relation to which a shaped portion of wire is to be positioned. In one such example, a work piece may comprise a portion of foam into which formed springs are to be deposited. An ancillary tool, such as a router, may be used to create an aperture or recess for receiving a spring. Another ancillary tool, such as a cutter/trimmer/cropper tool, may be used to crop or trip the work piece.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A wire shaping apparatus for shaping wire into springs, the apparatus comprising:

a movable positioning member;

a forming device mounted on the movable positioning member for moving the forming device, and a supply station, located remotely from the forming device and including a supply of spring wire for supplying a length of the spring wire to the forming device via a wire conduit, wherein the wire conduit comprises a sole mechanical connection between the supply station and the forming device, wherein the forming device includes:

at least one tool for shaping a portion of the wire into a spring; and at least one tool for cutting the spring from the length of wire, wherein the moveable positioning member is configured to move the forming device as a whole relative to, and independently of, the supply station in at least two-dimensions during operation of the apparatus, such that the spring shaped and cut by the forming device is located in a desired position where the cut spring can be used by the independent moving of the forming device relative to the supply station in the at least two-dimensions.

2. The wire shaping apparatus according to claim 1, wherein the supply station includes feed apparatus comprising at least one pair of rollers.

3. The wire shaping apparatus according to claim 1, wherein the wire conduit is in the form of a sheath or sleeve for supplying the wire to the forming device.

4. The wire shaping apparatus according to claim 1, wherein the supply station is configured to supply pre-straightened, drum-coiled wire to the forming device.

5. The wire shaping apparatus according to claim 1, wherein the supply station comprises a container, in which the wire is retained in a multitude of loops of substantially the same diameter around a cylindrical inside surface of the container.

6. The wire shaping apparatus according to claim 1, wherein the forming device further comprises one or more additional tools including one or more of: a pitch controlling tool, a heating tool and a fixing tool.

7. The wire shaping apparatus according to claim 6, wherein the apparatus comprises one or more ancillary tools arranged in use to move with the forming device.

8. The wire shaping apparatus according to claim 7, wherein the one or more ancillary tools are arranged as part of the forming device.

9. The wire shaping apparatus according to claim 7, wherein the one or more ancillary tools include one or more of: a cutter, router, drill, cropper, trimmer, laser.

10. The wire shaping apparatus according to claim 6, wherein operation of the one or more tools of the forming device is controlled remotely by a control apparatus.

11. The wire shaping apparatus according to claim 10, wherein the control apparatus is configured to communicate with the one or more tools of the forming device through a cable.

12. The wire shaping apparatus according to claim 1, wherein the forming device is moveable in two, or three, dimensions.

13. The wire shaping apparatus according to claim 12, wherein movement of the forming device is caused by a moveable arm or platform.

14. A method of shaping a wire into springs, the method comprising:

supplying a length of spring wire from a supply station that includes a supply of the spring wire to a remotely located forming device via a wire conduit, wherein:

the wire conduit comprises a sole mechanical connection between the supply station and the forming device, the forming device includes at least one tool for shaping a portion of the spring wire into a spring and at least one tool for cutting the spring from the length of spring wire, and the forming device is mounted on a moveable positioning member, shaping a portion of the spring wire into a spring and cutting the spring from a remaining length of wire using the tools of the forming device while moving the moveable positioning member and the forming device mounted to the movable positioning member as a whole relative to, and independently of, the supply station in at least two-dimensions to place the spring in a desired position where the spring is to be used.

15. The method according to claim 14, including positioning the shaped portion of wire in relation to a work piece.

16. The method according to claim 14, the method comprising operating one or more tools of the forming device remotely by a control apparatus.

17. The wire shaping apparatus according to claim 1, wherein the moveable positioning member is configured to move the forming device as a whole relative to, and independently of, the supply station in three-dimensions.

* * * * *